US006854266B2

(12) United States Patent
Schnaibel et al.

(10) Patent No.: US 6,854,266 B2
(45) Date of Patent: Feb. 15, 2005

(54) METHOD FOR DESULFURIZING A STORAGE MEDIUM

(75) Inventors: Eberhard Schnaibel, Hemmingen (DE); Klaus Winkler, Rutesheim (DE); Christoph Woll, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/344,017

(22) PCT Filed: Aug. 8, 2001

(86) PCT No.: PCT/DE01/03027

§ 371 (c)(1),
(2), (4) Date: Jul. 28, 2003

(87) PCT Pub. No.: WO02/14666

PCT Pub. Date: Feb. 21, 2002

(65) Prior Publication Data

US 2004/0011028 A1 Jan. 22, 2004

(30) Foreign Application Priority Data

Aug. 11, 2000 (DE) ..... 100 40 010

(51) Int. Cl.[7] ..... F01N 3/00

(52) U.S. Cl. ..... 60/295; 60/274; 60/276; 60/301

(58) Field of Search ..... 60/274, 276, 295, 60/301

(56) References Cited

U.S. PATENT DOCUMENTS 5,473,890 A * 12/1995 Takeshima et al. ..... 60/285
5,577,382 A * 11/1996 Kihara et al. ..... 60/276
5,724,808 A * 3/1998 Ito et al. ..... 60/276
5,832,722 A * 11/1998 Cullen et al. ..... 60/274
6,530,216 B2 * 3/2003 Pott ..... 60/286
6,637,190 B1 * 10/2003 Pott ..... 60/274

FOREIGN PATENT DOCUMENTS

| | | |
|---|---|---|
| DE | 197 31 624 | 1/1999 |
| DE | 198 23 921 | 12/1999 |
| DE | 198 47 875 | 4/2000 |
| DE | 199 10 503 | 7/2000 |
| DE | 199 54 549 | 5/2001 |
| EP | 1 050 675 | 11/2000 |
| WO | 01 44630 | 6/2001 |

* cited by examiner

*Primary Examiner*—Thomas Denion
*Assistant Examiner*—Diem Tran
(74) *Attorney, Agent, or Firm*—Kenyon & Kenyon

(57) ABSTRACT

A method of desulfurization of a ceramic storage medium for sulfur oxides and/or nitrogen oxides situated in a gas stream, in particular a storage device for nitrogen oxides or sulfur oxides situated in the exhaust gas stream of an internal combustion engine, is described, a mixture having a low oxygen concentration being established in the gas stream to release the stored sulfur oxides. A measuring signal is recorded by an oxygen probe positioned downstream from the storage medium in a gas stream flow direction, the curve of this measuring signal being used to determine the loading of the storage medium with sulfur oxides. This method allows determination of the need for desulfurization as a function of the loading of the storage medium with sulfur oxides, to monitor and control the progress of desulfurization initiated and to check on how complete the desulfurization that is concluded has been.

10 Claims, 1 Drawing Sheet

METHOD FOR DESULFURIZING A STORAGE MEDIUM

FIELD OF THE INVENTION

The present invention relates to a method of desulfurizing a storage medium for nitrogen oxides and/or sulfur oxides.

BACKGROUND INFORMATION

As a fuel-saving measure, internal combustion engines today are operated with a lean combustion mixture. This results in nitrogen oxides $NO_x$ being unable to react completely in a conventional catalytic converter, because the reducing components required for the reaction are no longer present in the exhaust gas in an adequate concentration. This is the reason for using $NO_x$ storage catalysts, which are capable of storing unconverted $NO_x$. They are regenerated intermittently by supplying reducing exhaust gas components.

Conventional commercial fuels contain small amounts of sulfur compounds, which release sulfur in the form of sulfur oxides during combustion of the fuel. $SO_2$ in particular is stored in the $NO_x$ storage catalyst in competition with nitrogen oxides, thereby decreasing the catalyst ability to absorb nitrogen oxides. There is an increasing accumulation of sulfur oxides in the $NO_x$ storage catalyst and thus a decreased storage capacity of the latter because nitrogen oxides are released in the intermittent regeneration of the $NO_x$ storage catalyst and are ideally converted to nitrogen, and yet the incorporated $SO_2$ remains in the $NO_x$ storage catalyst under the conditions prevailing during regeneration. To overcome this problem, a sulfur storage device may also be connected upstream from the $NO_x$ storage catalyst to absorb the sulfur compounds present in the exhaust gas before reaching the $NO_x$ storage catalyst.

In both cases, desulfurization must be performed intermittently when the storage capacity of the $NO_x$ storage catalyst or the sulfur storage device drops below a certain limit. German Published Patent Application No. 199 10 503 describes that an elevated temperature of 550° C. to 700° C. may be induced in the $NO_x$ storage catalyst or the sulfur storage device to perform desulfurization, and the combustion mixture may be established at a lambda value of <1.

It is a problem to determine a point in time when storage capacity of the $NO_x$ storage catalyst and/or the sulfur storage device has dropped below a certain limit and desulfurization must be initiated. In German Published Patent Application No. 199 10 503, desulfurization is performed periodically on the basis of characteristic data obtained in preliminary experiments. However, flexible control is not possible in this way.

SUMMARY OF THE INVENTION

The object of the present invention is to provide a method which permits a determination of the need for desulfurizing of a corresponding storage medium on the basis of a degree of loading while also ensuring control and/or monitoring of such a desulfurizing process and checking on how thorough the desulfurizing process has been.

The present invention permits a determination of the need for desulfurizing of a corresponding storage medium on the basis of a degree of loading by using an oxygen probe connected downstream from a storage medium for nitrogen oxides and/or sulfur oxides while also ensuring control and/or monitoring of such a desulfurizing process and checking on how thorough the desulfurizing process has been.

The need for desulfurizing the storage medium is determined accurately by a simple method by intermittently establishing the mixture in the exhaust gas stream to have a low oxygen content, and using the change in the measuring signal of the oxygen probe, the maximum gradient of this change or the integral of the change over time as a measure of the loading of the storage medium with sulfur oxides.

In addition, a corresponding analysis of the measuring signal of the oxygen probe during desulfurization permits accurate control and monitoring of the process.

DETAILED DESCRIPTION

The basic configuration of a measurement system with which a method according to the present invention is performed is described below. The exhaust gas of an internal combustion engine is carried in an exhaust gas line 11, from which the line 11 enters a $NO_x$ storage catalyst 12. While a lean combustion mixture is established, nitrogen oxides and/or sulfur oxides present in the exhaust gas are stored. The nitrogen oxides are reacted catalytically with reducing compounds such as hydrogen, hydrocarbons and carbon monoxide during a subsequent regeneration phase. After leaving $NO_x$ storage catalyst 12, the oxygen concentration in the exhaust gas is determined by using an oxygen probe 14. To prevent sulfur oxides from being incorporated into $NO_x$ storage catalyst 12, an additional storage medium 10 for sulfur oxides may optionally be connected upstream in a direction of flow of the exhaust gases. Sulfur oxides $SO_x$ contained in the exhaust gas and absorbed there and stored temporarily in the form of sulfates.

The excess fuel prevailing in the exhaust gas during the regeneration phase allows the nitrogen oxides stored in $NO_x$ storage catalyst 12 to react. However, the sulfur oxides which are also bound there are hardly released at all. Therefore, these compounds accumulate in $NO_x$ storage catalyst 12. It is possible to track this accumulation directly by the measuring signal of oxygen probe 14.

Figure 1:
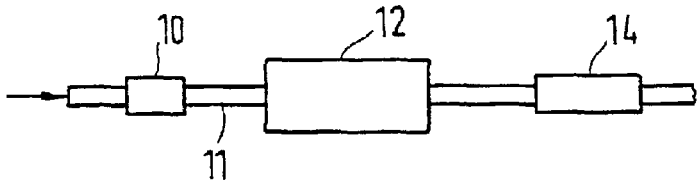
FIG. 1 is a diagram of the measurement system needed for executing a method according to the present invention.
Figure 2:
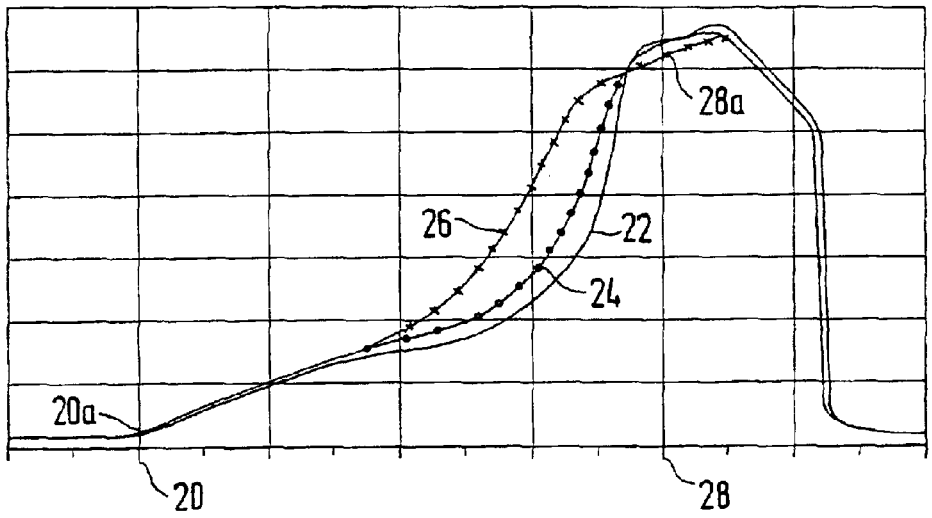
FIG. 2 is a schematized diagram of measurement curves obtained by using the measurement system.

FIG. 2 illustrates the measuring signal of oxygen probe 14 plotted as a function of time. The measuring signal of oxygen probe 14 is recorded here as a voltage which depends on the oxygen concentration of the exhaust gas, low voltage levels corresponding to a high oxygen concentration and vice versa.

Before time 20, a high oxygen concentration 20*a* prevails in the exhaust gas, and the nitrogen oxides present in this lean exhaust gas are incorporated into $NO_x$ storage catalyst 12. At point in time 20, the storage capacity of $NO_x$ storage catalyst 12 is exhausted and regeneration is initiated. To do so, the engine is operated at a fuel excess and thus at a lambda value of <1.

Measurement curve 22, which results during the regeneration phase, is characterized by an initially gradual increase and with a last steep increase in the measuring signal of oxygen probe 14. This is due to the fact that at first, due to the release and reduction of nitrogen oxides downstream from $NO_x$ storage catalyst 12, a higher oxygen concentration is created in the exhaust gas than previously formed, and oxygen probe 14 registers only a gradual decline in the oxygen concentration at the beginning of the regeneration phase. Only toward the end of the regeneration phase does the oxygen concentration drop suddenly. The end of the regeneration phase occurs at point in time 28.

Measurement curve 22 illustrates a typical characteristic of measuring signals of an $NO_x$ storage catalyst 12 without any sulfur oxide loading. With increased loading of $NO_x$ storage catalyst 12 with sulfur oxides, the measuring signals of downstream oxygen probe 14 yield measurement curves 24, 26.

During the regeneration phase, an increasing accumulation of sulfur oxides in $NO_x$ storage catalyst 12 results in a comparatively more rapid decline in the oxygen concentration in the exhaust gas downstream from $NO_x$ storage catalyst 12 because of the smaller quantity of nitrogen oxides storable there, and thus results in the shallow early rise in the measuring signal of oxygen probe 14 illustrated in measurement curves 24, 26. At the same time, the absolute value of measuring signal 28*a* obtained at point in time 28 noticeably drops increasingly with an increasing load and/or the residual oxygen concentration at point in time 28 increases more and more.

This change in the shape of the curve during the regeneration phase of $NO_x$ storage catalyst 12 is used to determine the sulfur oxide loading of $NO_x$ storage catalyst 12, and as a result, the need for desulfurization may be derived.

The difference between the minimum and maximum measured values of oxygen probe 14 within interval of time 20, 28 is used as the criterion for the loading of $NO_x$ storage catalyst 12 with sulfur oxides. The magnitude of measuring signal 28*a* depends on the loading of $NO_x$ storage catalyst 12, so desulfurization is started as soon as the difference between measuring signals 20*a*, 28*a* drops below a certain value. The difference between the oxygen concentration calculated from the measuring signals, which is high at the beginning of interval 20, 28 and is low toward the end, may be used wherein desulfurization may be initiated as soon as the absolute value of the difference in the oxygen concentrations drops below a predetermined value.

The curve of the measuring signal of oxygen probe 14, which is shallower with increasing sulfur oxide loading of $NO_x$ storage catalyst 12, allows a use of the gradient of measurement curves 22, 24, 26 as an additional criterion for the loading of $NO_x$ storage catalyst 12. Thus, desulfurization of $NO_x$ storage catalyst 12 is initiated when an absolute value of the maximum gradient of measurement curves 22, 24, 26 determined during the regeneration phase drops below a predetermined value. This is true for the oxygen concentrations determined from measurement curves 22, 24, 26.

A third criterion for the loading of an $NO_x$ storage catalyst 12 with sulfur oxides is obtained by integration of measuring signals determined between points in time 20, 28 over time. Desulfurization is initiated when the absolute value of this integral exceeds a predetermined value. The oxygen concentrations calculated between points in time 20, 28 may also be integrated similarly. Desulfurization may also be initiated when this integral falls below a predetermined value.

Desulfurization may be performed in two ways. One possibility is to heat the catalyst to a temperature above 550° C. to 600° C. and to establish a lambda value of <1, such as 0.95 to 0.97, in the exhaust gas. If the lambda value is lower, there is the risk of forming toxic hydrogen sulfide during desulfurization.

The progress in desulfurization is also monitored on the basis of the measuring signal of oxygen probe 14. This yields a curve of the measuring signal which greatly resembles measuring curve 22 illustrated in FIG. 2, point in time 20 corresponding to the start of desulfurization and point in time 28 corresponding to the end.

The release of sulfur oxides proceeds schematically according to the following equation:

$$BaSO_4+CO_2 \rightarrow BaCO_3+SO_2+\tfrac{1}{2}O_2$$

In the release of the sulfur oxides, the oxygen content in the exhaust gas increases, and a higher oxygen concentration is measured downstream from $NO_x$ storage catalyst 12 than upstream. Desulfurization is concluded as soon as the oxygen concentration determined by oxygen probe 14 drops below a predetermined value. The measuring signal of oxygen probe 14 may be used directly to control the combustion mixture supplied to the internal combustion engine. Thus, the exhaust gas is established to have a very low oxygen concentration (to be rich) via a proportional control at a low probe voltage, and the fuel excess is recycled with an increase in probe voltage through a decline in the proportional component. Regulation systems having an integral or differential component are also possible (PID regulator).

Figure 3A:
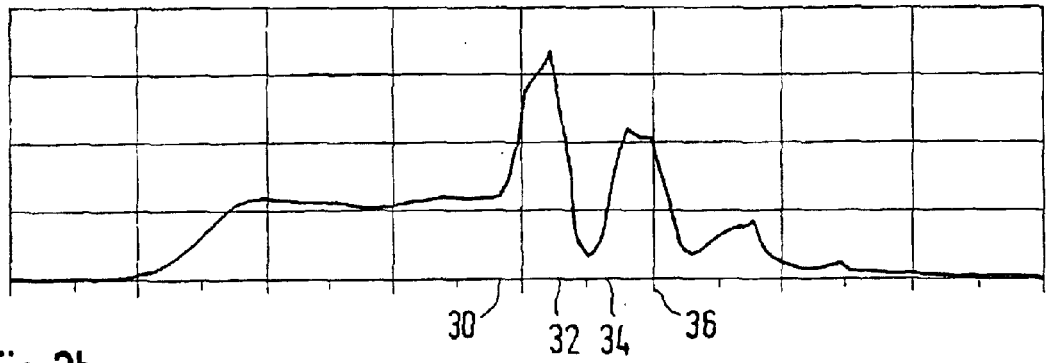
FIG. 3*a* is another schematized diagram of measurement curves obtained by using the measurement system.
Figure 3B:
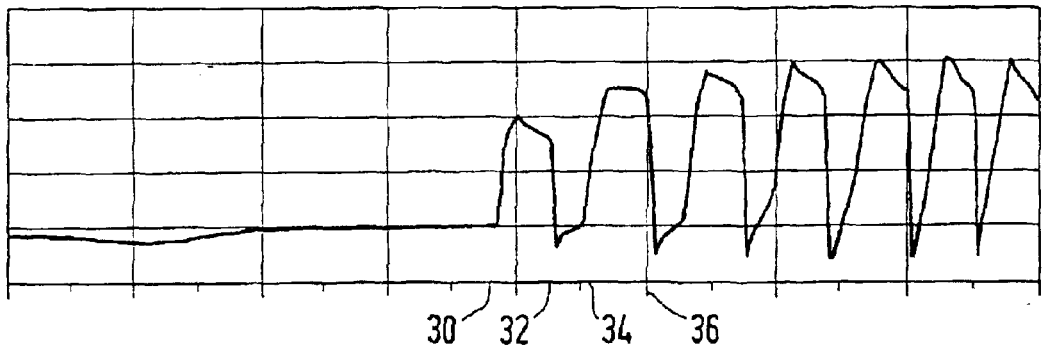
FIG. 3*b* is another schematized diagram of the measurement curves obtained by using the measurement system.

As an alternative to the one-point regulation of the lambda value described here, desulfurization may also be accomplished by two-point regulation of the exhaust gas composition. Two different lambda values are established in periodic sequence in the exhaust gas under the same temperature conditions in the catalyst. One of the lambda values may be selected to be <1 and one may be selected to be >1, e.g., $\lambda_1$=0.95 and $\lambda_2$=1.04. FIG. 3*b* illustrates measuring signals determined by oxygen probe 14 over time. FIG. 3*a* illustrates the $SO_2$ concentrations determined in the exhaust gas by a test device, plotted in parallel over time.

Time 30 marks a beginning of desulfurization, e.g., when a low lambda value ($\lambda_1$) is established. FIG. 3*a* illustrates that even before time 30, there was a significant amount of $SO_2$ in the exhaust gas. After time 30, there is an increase in the probe signal, as illustrated in FIG. 3*b*, in parallel with the definite discharge of $SO_2$ discernible in FIG. 3*a*. At time 32, a higher lambda value ($\lambda_2$) is established, resulting in a drop in the probe signal and an interruption in the $SO_2$ discharge. However, this higher lambda value ensures that no hydrogen sulfide is discharged. Time 34 marks the renewed establishment of $\lambda_1$ followed by a renewed establishment of $\lambda_2$. This is continued periodically. FIGS. 3*a* and 3*b* illustrate that the $SO_2$ discharge declines with increasing desulfurization, and in parallel, the maximum measuring signal of oxygen probe 14 increases and the minimum oxygen concentration derivable therefrom decreases. Desulfurization is concluded when the maximum measuring signal exceeds a predetermined value and/or the minimum oxygen concentration falls below a predetermined value.

To check on how thorough desulfurization has been, a storage and regeneration cycle of the $NO_x$ storage catalyst is implemented after an end of desulfurization, and the measurement curve plotted by the oxygen probe during the regeneration phase is compared with a stored measurement curve 22, which was recorded in the case of an $NO_x$ storage catalyst 12 not loaded with sulfur oxides. If the measured curve recorded after desulfurization deviates with regard to end point 28*a*, gradient or integral from measurement curve 22 beyond a predetermined extent, desulfurization is initiated again or an error signal is output.

The method described here is used similarly in exhaust systems which also have a sulfur storage device 10 and/or an oxidation catalyst connected upstream from $NO_x$ storage catalyst 12.

Heating of $NO_x$ storage catalyst 12 and/or sulfur storage device 10 during desulfurization is accomplished electrically, by varying the firing angle of the internal combustion engine or by adding a substance that releases heat by combustion to the exhaust system.

The present invention also relates to a combination of the monitoring options described here as well as a transfer of these methods to other embodiments of the measurement system.

The method on which the present invention is based is not limited to the use of potentiometric oxygen probes, but instead amperometric oxygen probes or probes based on a combination of the two measurement methods are suitable.

What is claimed is:

1. A method of desulfurization of a storage medium for at least one of nitrogen oxides and sulfur oxides situated in a gas stream, comprising:

recording a measuring signal using an oxygen probe situated downstream from the storage medium in a direction of flow of the gas stream;

using a plotted curve of the measuring signal over time to determine a loading of the storage medium with sulfur oxides, wherein desulfurization is initiated as a function of the plotted curve;

establishing a mixture having a low oxygen concentration in the gas stream at predetermined intervals for determining the loading of the storage medium; and using a change in the measuring signal of the oxygen probe as a measure of a need for desulfurization of the storage medium after establishing the mixture having the low oxygen concentration in the gas stream;

wherein a difference between a first measuring signal of the oxygen probe upon initial establishment of the mixture having the low oxygen concentration and a second measuring signal at an end of establishment of the mixture having the low oxygen concentration in the gas stream is used as a measure of the loading of the storage medium with sulfur oxides, and wherein a desulfurization of the storage medium is initiated when an absolute value of the difference drops below a predetermined value.

2. A method of desulfurization of a storage medium for at least one of nitrogen oxides and sulfur oxides situated in a gas stream, comprising:

recording a measuring signal using an oxygen probe situated downstream from the storage medium in a direction of flow of the gas stream;

using a plotted curve of the measuring signal over time to determine a loading of the storage medium with sulfur oxides, wherein desulfurization is initiated as a function of the plotted curve;

establishing a mixture having a low oxygen concentration in the gas stream at predetermined intervals for determining the loading of the storage medium; and using a change in the measuring signal of the oxygen probe as a measure of a need for desulfurization of the storage medium after establishing the mixture having the low oxygen concentration in the gas stream;

wherein a gradient of the change in the measuring signal of the oxygen probe after establishing a mixture having a low oxygen concentration in the gas stream is used as a measure of the loading of the storage medium with sulfur oxides, and wherein a desulfurization of the storage medium is initiated when a maximum absolute value of the gradient drops below a predetermined value.

3. A method of desulfurization of a storage medium for at least one of nitrogen oxides and sulfur oxides situated in a gas stream, comprising:

recording a measuring signal using an oxygen probe situated downstream from the storage medium in a direction of flow of the gas stream;

using a plotted curve of the measuring signal over time to determine a loading of the storage medium with sulfur oxides, wherein desulfurization is initiated as a function of the plotted curve;

establishing a mixture having a low oxygen concentration in the gas stream at predetermined intervals for determining the loading of the storage medium; and using a change in the measuring signal of the oxygen probe as a measure of a need for desulfurization of the storage medium after establishing the mixture having the low oxygen concentration in the gas stream;

wherein an integral over time of the measuring signal of the oxygen probe after the establishing of the mixture having the low oxygen concentration in the gas stream is used as the measure of the loading of the storage medium with sulfur oxides, and wherein a desulfurization of the storage medium is initiated when an absolute value of the integral drops below a predetermined value.

4. The method according to claim 1, further comprising:

establishing, after an end of the desulfurization, a low oxygen concentration in the gas stream; and using a difference between a first measuring signal of the oxygen probe upon initial establishment of the mixture having the low oxygen concentration in the gas stream and a second measuring signal at the end of establishment of the mixture having the low oxygen concentration in the gas stream as a measure of completeness of desulfurization.

5. The method according to claim 1, further comprising:

establishing, after an end of desulfurization, a low oxygen concentration in the gas stream; and using a gradient of a change in the measuring signal of the oxygen probe after establishing the mixture having the low oxygen concentration in the gas stream as a measure of completeness of desulfurization.

6. The method according to claim 1, further comprising:

establishing, after an end of desulfurization, a low oxygen concentration in the gas stream; and using an integral over time of a change in the measuring signal of the oxygen probe after establishing the mixture having the low oxygen concentration in the gas stream as a measure of completeness of desulfurization.

7. The method according to claim 1, 2, or 3, further comprising:

establishing a constantly low oxygen concentration in the gas stream for desulfurization of the storage medium;

tracking a progress in desulfurization on a basis of a change in the measuring signal of the oxygen probe; and concluding the desulfurization when the measuring signal of the oxygen probe reaches a predetermined value.

8. The method according to claim 7, wherein the constantly low oxygen concentration in the gas stream corresponds to a lambda value of 0.94 to 0.99.

9. The method according to claim 1, 2, or 3, further comprising:

establishing a low oxygen concentration varying periodically between two concentration values for desulfurization of the storage medium;

tracking a progress in desulfurization on a basis of a change in the measuring signal of the oxygen probe; and concluding the desulfurization when an extreme of the measuring signal of the oxygen probe reaches a predetermined value.

10. The method according to claim 9, wherein the two concentration values established for the desulfurization of the storage medium correspond to lambda values $\lambda 1$ and $\lambda 2$, wherein $\lambda 1$ corresponds to a value of 0.94 to 1.0, and wherein $\lambda 2$ corresponds to a value of 0.96 to 1.1.

* * * * *